US005082230A

United States Patent [19]

Chang

[11] Patent Number: 5,082,230

[45] Date of Patent: Jan. 21, 1992

[54] ADJUSTING DEVICE FOR A FRAME PRODUCT

[76] Inventor: Houn I. Chang, No. 24, Hsi Tou Rd., Hsi Pan Village, Hsi Chou Hsiang, Chang Hua Hsien, Taiwan

[21] Appl. No.: 616,616

[22] Filed: Nov. 21, 1990

[51] Int. Cl.[5] ..... A47G 1/08

[52] U.S. Cl. ..... 248/476; 248/455; 248/447.1; 248/279

[58] Field of Search ..... 248/476, 486, 485, 455, 248/447.1, 126, 279, 188.7

[56] References Cited

U.S. PATENT DOCUMENTS

| | | | |
|---|---|---|---|
| 1,448,024 | 3/1923 | Brizgis | 248/476 X |
| 1,918,802 | 7/1933 | Fleischer | 248/485 X |
| 2,335,896 | 12/1943 | Anderson | 248/476 |
| 2,943,536 | 7/1960 | Stafford | 248/279 X |
| 3,074,680 | 1/1963 | Stewart | 248/476 X |
| 3,715,097 | 2/1973 | Kalajran | 248/455 X |
| 4,116,413 | 9/1978 | Anderson | 248/455 X |
| 4,181,282 | 1/1980 | Oliver et al. | 248/455 X |
| 4,197,685 | 4/1980 | Goulish et al. | 248/188.7 X |
| 4,482,185 | 11/1984 | Zoellner | 248/455 X |
| 4,602,855 | 7/1986 | Frey | 248/476 X |

FOREIGN PATENT DOCUMENTS

| | | | |
|---|---|---|---|
| 0173822 | 7/1952 | Fed. Rep. of Germany | 248/455 |
| 0497667 | 12/1938 | United Kingdom | 248/486 |

*Primary Examiner*—Alvin C. Chin-Shue
*Attorney, Agent, or Firm*—Merchant, Gould, Smith, Edell, Welter & Schmidt

[57] ABSTRACT

An adjusting device includes a channel fixed to a rear surface of a frame. A slot is longitudinally formed in a rear surface of the channel. A guide is slidably received in the channel. A lug is formed on the guide and extends outward from the slot. A lug is formed on a hanger. The ends of a link are coupled to the lugs by screws and nuts so that the relative angles between the channel and the link and between the link and the hanger can be adjusted by the screws and nuts, and so that the frame can be easily adjusted to a suitable angle relative to a support surface.

3 Claims, 6 Drawing Sheets

ADJUSTING DEVICE FOR A FRAME PRODUCT

BACKGROUND OF THE INVENTION

The present invention relates to an adjusting device, and more particularly to an adjusting device for a frame product.

Generally, the frame products, especially the frames for pictures are directly hung on a nail which is hammered or screwed on the wall so that the rear surfaces of the frame products contact the wall. In order to adjust the angle of the frame products relative to the wall, a metal wire or the like is coupled between the upper end of the frame product and the wall so that the frame product faces downward with an inclined angle. The coupling of the wire is very inconvenient.

The present invention has arisen to mitigate and/or obviate the afore-described disadvantages of the conventional frame products for pictures.

SUMMARY OF THE INVENTION

The primary objective of the present invention is to provide an adjusting device which can adjust an angular position of a frame product easily.

In accordance with one aspect of the invention, there is provided an adjusting device which includes a channel vertically fixed to a rear surface of the frame. A slot is longitudinally formed in a rear surface of the channel. A guide is slidably received in the channel and can be fixed in the channel by a screw. A lug is perpendicularly formed on the guide and extends outward from the slot of the channel. A lug is perpendicularly formed on a hanger which can be hung on a nail. Both ends of a link are coupled to the lugs of the guide and of the hanger respectively by screws and nuts so that the relative angles between the channel and the link and between the link and the hanger can be adjusted by the screws and nuts, and so that the frame can be easily adjusted to a suitable angle relative to a support surface.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
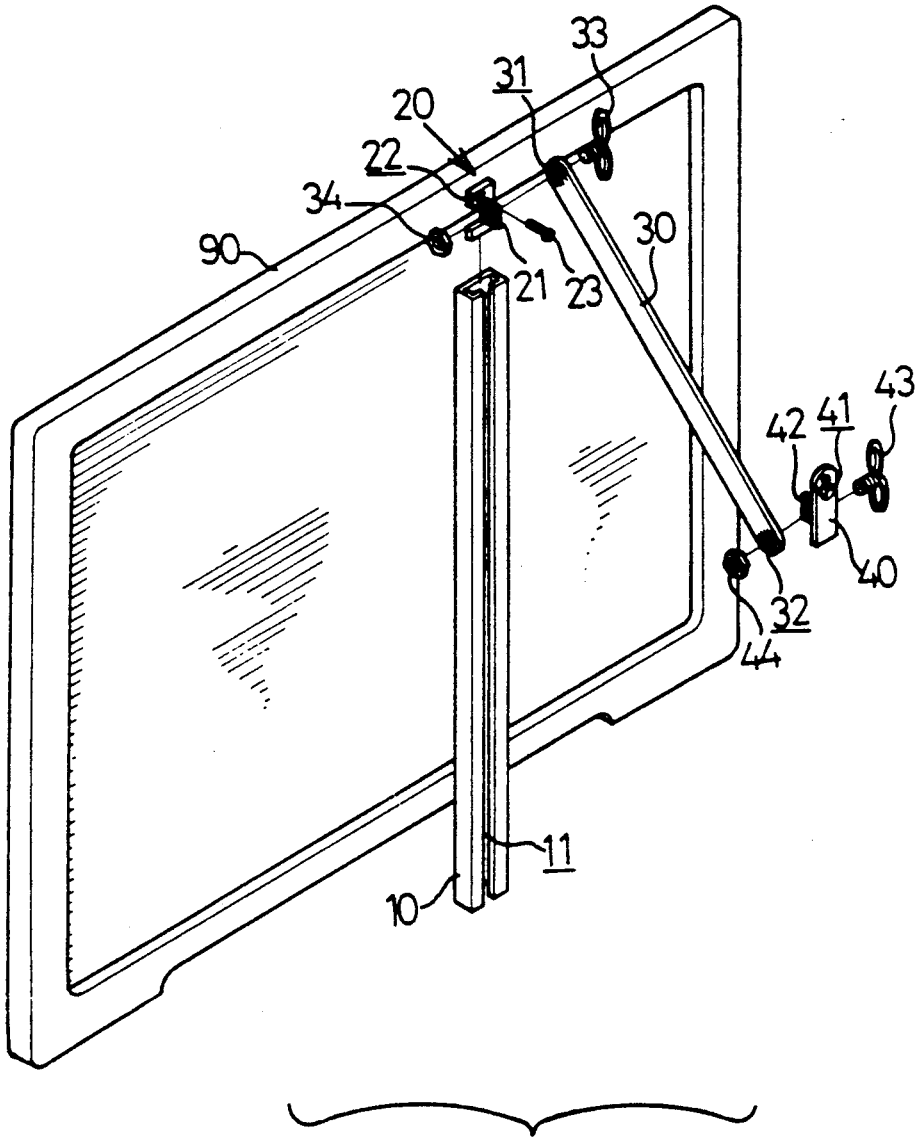
FIG. 1 is an exploded view of a frame product and an adjusting device in accordance with the present invention.
Figure 2:
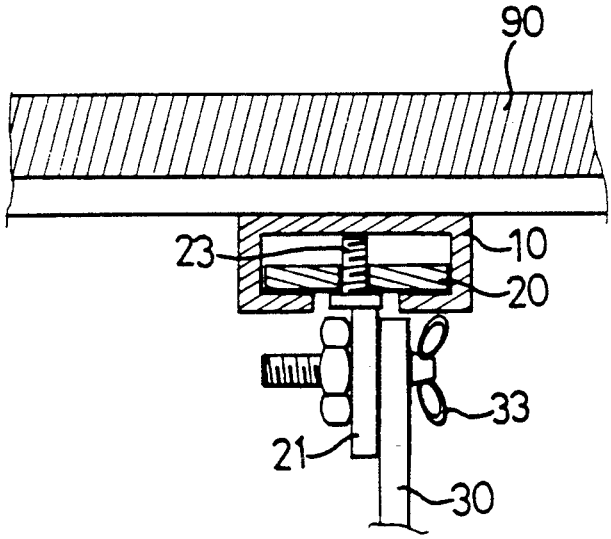
FIG. 2 is a cross sectional view illustrating a coupling of a guide within a channel.
Figure 3:
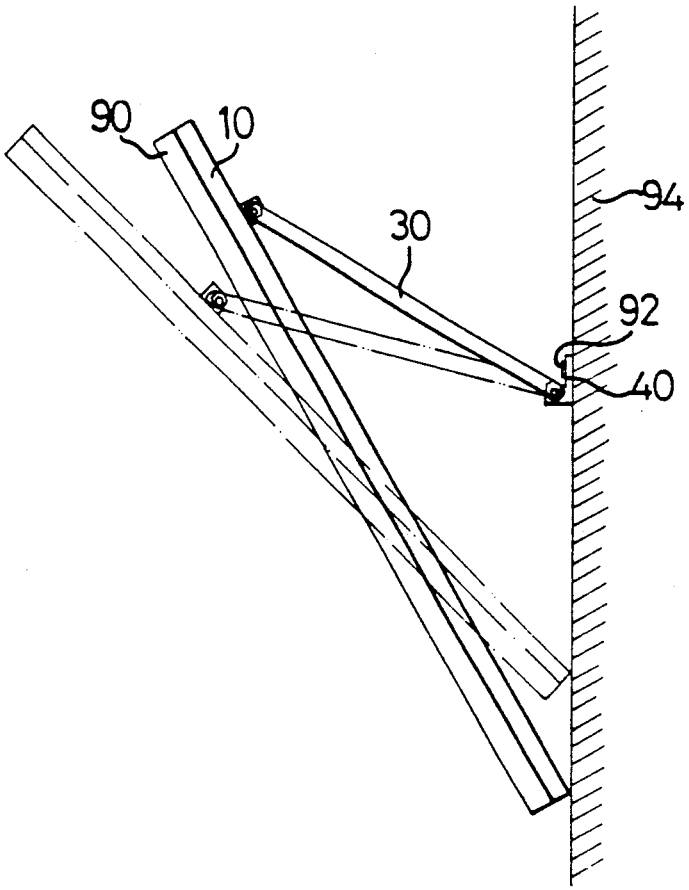
FIGS. 3, 4 and 5 are side views embodying the invention.

Referring to the drawings and initially to FIGS. 1, 2 and 3, the adjustting devicein accordance with the present invention comprises generally a channel 10 fiixed to a rears urface of a frame 90, and a link 30 having one end slidably engaged within the channel 10 and having another end coupled to a wall.

The channel 10 is substantially a hollow tube and has a C-shaped cross section with a slot 11 longitudinally formed in the middle of a rear surface of the channel 10.

The front surface of the channel 10 is vertically fixed across the middle portion of the rear surface of the frame 90. A guide 20 is slidable within and along the channel 10. A lug 21 is integrally formed on the guide 20 and is substantially perpendicular to the guide 20. A hole is formed in middle portion of the lug 21. The lug 21 extends outward from the slot 11 and is guided to slide along the slot 11 when the guide 20 is slidably received within the channel 10. Both sides of the lug 21 are embossed or knurled. A screw hole 22 is formed in the guide 20 and preferably formed above the lug 21. A screw 23 is threadedly engaged within the screw hole 22 in order to fixed the guide 20 in place, as shown in FIG. 2.

The link 30 is substantially a strip of plate with a hole 31, 32 formed in each end thereof. Both sides of both ends of the link 30 are embossed or knurled. One end of the link 30 and the lug 21 are coupled together by a wing screw 33 and a nut 34. The embossment on either the lug 21 or the end portion of the link 30 facilitates an engagement between the lug 21 and the link 30 so that the link 30 can be maintained at a required angle relative to the channel 10 and the frame 90 (FIG. 3).

A key hole 41 is formed in the upper end of a hanger 40 and is engageable with a screw or a nail 92 which is hammered into a wall 94 so that the hanger 40 can be hung on the wall 94. A lug 42 is integrally and perpendicularly formed on one side of the hanger 40. A hole is formed in the middle portion of the lug 42. Both sides of the lug 42 are embossed or knurled. The other end of the link 30 and the lug 42 of the hanger 40 are coupled together by a wing scew 43 and a nut 44. The embossment on either the lug 42 or the end portion of the link 30 facilitates an engagement between the lug 42 and the link 30 so that the link 30 can be maintained at a required angle relative to the hanger 40 and the wall 94 (FIG. 3).

In use, as shown in FIG. 3, the nail 92 is fixed to the wall 94. One end of the link 30 is coupled to the lug 21 of the guide 20 by the wing screw 33 and the nut 34, and the other end of the link 30 is coupled to the lug 42 of the hanger 40 by the wing screw 43 and the nut 44. The frame 90 can be easily hung onto the wall when the key hole 41 of the hanger 40 is engaged on the nail 92. When it is required to adjust the relative angle between the frame 90 and the wall 94, it is only required to adjust either of the wing screws 33, 43 so that the relative angle between the frame 90 and the wall 94 can be easily adjusted.

Figure 4:
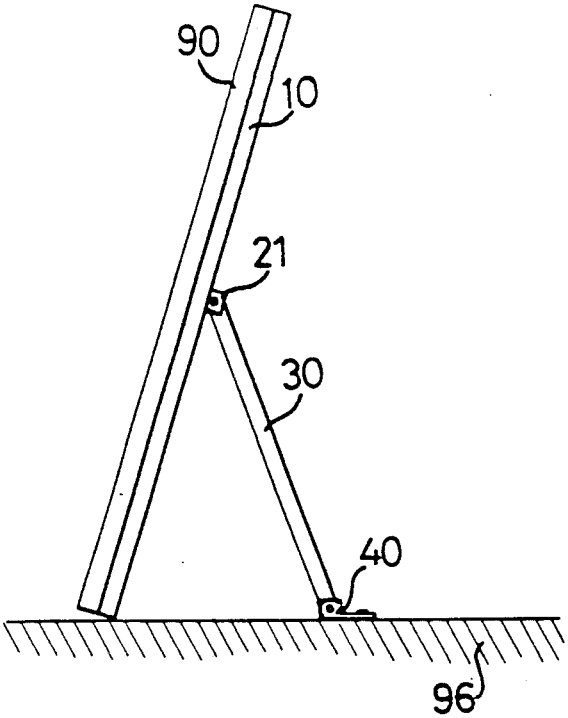

Referring next to FIG. 4, when the guide 20 is moved to the middle portion of the channel 10 and the hanger 40 is fixed on a table surface 96 or the like, the frame 90 can also be stably supported on the table.

Figure 5:
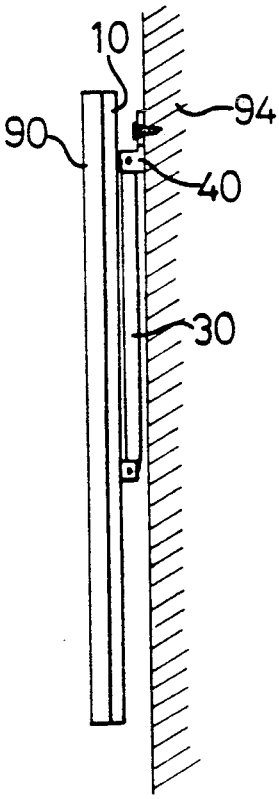

Referring next to FIG. 5, when the link 30 is adjusted to a position in parallel to the frame 90, the frame 90 can be hung on the wall in a position in parallel to the wall.

Figure 6:
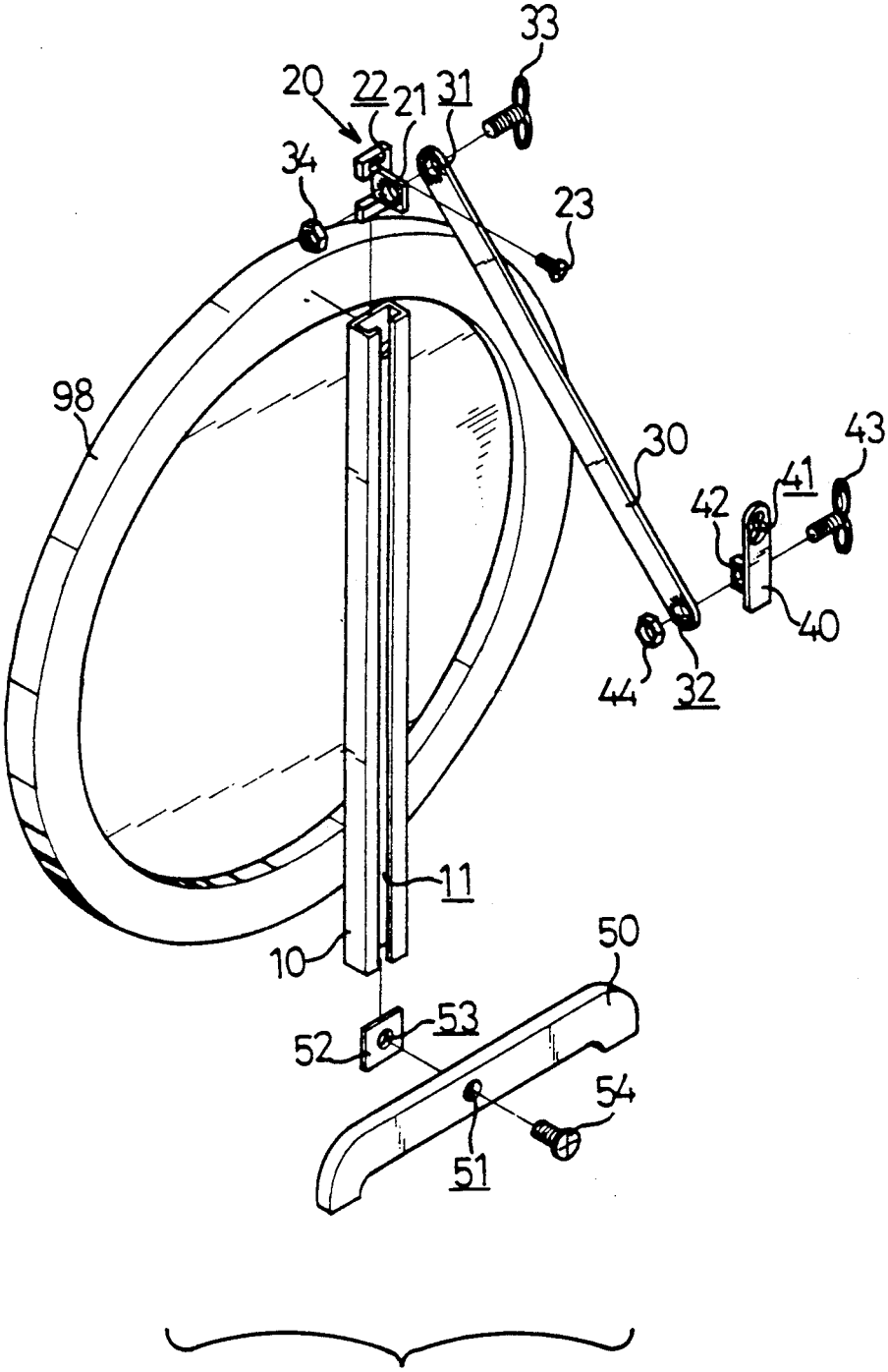
FIG. 6 is an exploded view of another embodiment of the invention.
Figure 7:
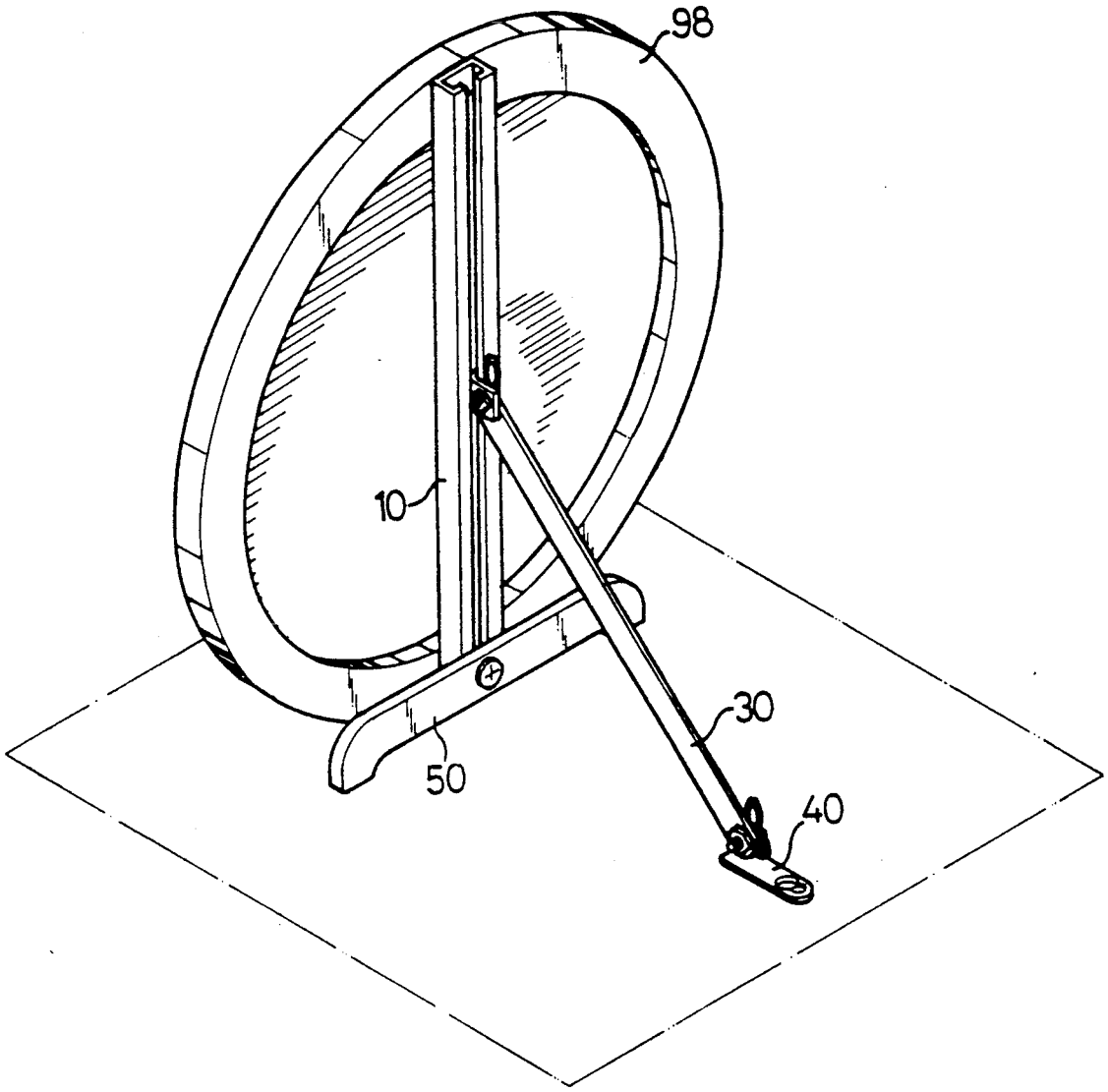
FIG. 7 is a perspective view of the embodiment shown in FIG. 6.

Referring next to FIGS. 6 and 7, when the frame 98 is not a rectangular frame but a circular frame, the bottom side of the frame 98 can not stably stand on a table surface. A stand 50 is fixed to the lower end of the channel 10 which is fixed to the rear surface of the frame 98 so that the frame 98 can stably stand on a table surface or the like. A hole 51 is formed in the middle portion of the stand 50. A screw hole 53 is formed in the middle of a square washer 52 which can be inserted into the lower end of the channel 10. A screw 54 passes through the hole 51 of the stand 50 and is threadedly engaged with the screw hole 53 of the square washer 52 so that the stand 50 can be fixed to the lower end of the channel 10. When the link 30 is adjusted so that a suitable angle is formed between the channel 10 and the link 30, the frame 98 can be supported by the link 30 and can stably stand on a table surface.

Accordingly, the adjusting device in accordance with the present invention is useful for supporting a frame for picture, and the frame which employs the adjusting device can be easily adjusted to a suitable angle relative to a wall or a table surface.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjusting device for a frame product comprising a channel having a front surface vertically fixed to a rear surface of said frame product, said channel being substantially a hollow tube having a slot longitudinally formed in a rear surface thereof; a guide slidably received in said channel and having a first screw hole formed therein for threadedly receiving a first screw so that said guide can be fixed to said channel; a first lug integrally and perpendicularly formed on said guide and extending outwardly from said slot of said channel; a link having a first end coupled to said first lug by a second screw and a first nut; a hanger having a key hole formed therein for engagement with a nail which is fixed on a support surface; a second lug integrally and perpendicularly formed on one side of said hanger, said link having a second end coupled to said second lug by a third screw and a second nut; one side of each of said first lug and said second lug having an embossment formed thereon, and one side of each end of said link having an embossment formed thereon, said embossments of said first lug and said second lug and said link facilitating an engagement between said first lug and said link and an engagement between said second lug and said link; a relative angle between said channel and said link can be adjusted by said second screw and said first nut, and a relative angle between said link and said hanger and said support surface can be adjusted by said third screw and said second nut so that said frame product can be easily adjusted to a suitable angle relative to said support surface; said frame product can be stably hung on said support surface by its own weight and by a friction between said frame product and said support surface.

2. An adjusting device for a frame product comprising a channel having a front surface vertically fixed to a rear surface of said frame product, said channel being substantially a hollow tube having a slot longitudinally formed in a rear surface thereof; a guide slidably received in said channel and having a first screw hole formed therein for threadedly receiving a first screw so that said guide can be fixed to said channel; a first lug integrally and perpendicularly formed on said guide and extending outward from said slot of said channel; a link having a first end coupled to said first lug by a second screw and a first nut; a hanger having a key hole formed therein for fixing to a support surface; a second lug integrally and perpendicularly formed on one side of said hanger, said link having a second end coupled to said second lug by a third screw and a second nut; a square washer being received in a lower end of said channel and having a second screw hole formed in a middle portion thereof, a stand having a hole formed in a middle portion thereof, and a fourth screw passing through said hole of said stand and being threadedly engaged with said second screw hole so that said stand can be fixed to said lower end of said channel, said frame product can be supported on said support surface by said stand and said link; one side of each of said first lug and said second lug having an embossment formed thereon, and one side of each end of said link having an embossment formed thereon, said embossments of said first lug and said second lug and said link facilitating an engagement between said first lug and said link and an engagement between said second lug and said link; a relative angle between said channel and said link can be adjusted by said second screw and said first nut so that said frame product can be easily adjusted to a suitable angle relative to said support surface.

3. A device in accordance with claim 1, wherein a lower edge of the frame product engages said support surface when hung on said support surface.

* * * * *